US005447539A

United States Patent [19]

Kelly et al.

[11] Patent Number: 5,447,539

[45] Date of Patent: Sep. 5, 1995

[54] METHOD OF DYEING POLYPROPYLENE FIBER WITH MORE THAN ONE COLOR

[75] Inventors: David R. Kelly, Dalton, Ga.; Hobert C. Sweatman, Soddy, Tenn.; Robert R. Hixson, Rossville, Ga.

[73] Assignee: DKE Incorporated, Dalton, Ga.

[21] Appl. No.: 194,514

[22] Filed: Feb. 10, 1994

[51] Int. Cl.[6] ..... D06P 3/79; D06P 5/00

[52] U.S. Cl. ..... 8/485; 8/478; 8/483; 8/487; 8/499; 8/928; 8/933; 8/DIG. 9

[58] Field of Search ..... 8/478, 483, 485, 487, 8/499, 611, 114, 139, 933, 934, 928, DIG. 9

[56] References Cited

U.S. PATENT DOCUMENTS

| | | | |
|---|---|---|---|
| 3,128,146 | 4/1964 | Bianco et al. | 8/928 |
| 3,652,198 | 3/1972 | Farber et al. | 8/485 |
| 3,775,054 | 11/1973 | De Vinney | 8/485 |
| 3,926,547 | 12/1975 | O'Mahony et al. | 8/485 |
| 3,964,862 | 6/1976 | Kangle et al. | 8/928 |
| 4,146,362 | 3/1979 | Nichols, Jr. | 8/485 |
| 4,189,302 | 2/1980 | Toland | 8/485 |
| 4,264,326 | 4/1981 | Rau | 8/662 |
| 4,329,143 | 5/1982 | Hutcheson | 8/485 |
| 4,578,836 | 4/1986 | Otting et al. | 8/485 |
| 4,808,191 | 2/1989 | Gregory et al. | 8/485 |
| 5,019,131 | 5/1991 | Nitsch, Jr. | 8/482 |

*Primary Examiner*—Paul Lieberman
*Assistant Examiner*—Caroline L. Dusheck
*Attorney, Agent, or Firm*—Levine & Mandelbaum

[57] ABSTRACT

A method of dyeing polypropylene fiber to create areas of different color on the fiber. A first dye solution containing a disperse dye and a dye-promoting agent is applied to substantially the entire surface of the fiber to cover the fiber with a first color. Thereafter, and while the fiber surface is still wet with the first dye solution, a second dye solution containing a disperse dye of a second color is applied only to selected discontinuous areas of the fiber. The second dye solution displaces the first dye solution in those areas of the fiber surface to which the second dye solution is applied. Then, the fiber is subjected to an elevated temperature high enough, and for a period of time sufficient, to fix the dyes in the fiber. Preferably, the second dye solution is more viscous than the first dye solution. After the dye fixation step, the fiber is scoured to remove excess dye. If desired, the second dye solution also contains a dye-promoting agent.

21 Claims, No Drawings

METHOD OF DYEING POLYPROPYLENE FIBER WITH MORE THAN ONE COLOR

This invention relates to dyeing and printing of polypropylene fiber, and products made therefrom, and more particularly to dyeing and/or printing unmodified polypropylene fiber with more than one color.

Polypropylene is difficult to dye since its structure cannot be readily penetrated, and it does not include dye sites to which certain kinds of dyes will bind. As a result, polypropylene is generally considered to be an undyeable fiber.

Attempts have been made to dye polypropylene, mostly without success. A primary approach has been the investigation of solvents capable of penetrating the polypropylene structure so as to carry a dyestuff into the penetrated fiber. However, polypropylene is virtually insoluble in solvents and dye carriers which have been tried. U.S. Pat. No. 4,056,354 describes dyeing a host a fibers, including polypropylene, by contacting the fiber with a solution of ethylene glycol and food or solvent dyes at elevated temperatures. However, at least in the case of polypropylene, these dyes do no more than stain the outer surface of the fiber but do not penetrate into the fiber structure. Consequently, the polypropylene fiber is not truly dyed.

Other methods of dyeing polypropylene involve modifying the fiber so that it will more readily accept a dye. For example, as described in U.S. Pat. No. 3,256,364 polypropylene has been blended with a different dyeable polymer, such as by copolymerization or grafting. The problems presented by this approach include poor uniformity of dyeing and the fact that the blended fiber does not have the same identification or properties as pure polypropylene.

Another fiber modification approach involves incorporating into the polypropylene, compounds capable of reacting with specially formulated dyes containing transition metals, such as nickel or cobalt. Such a fiber can be dyed, due to an electron-sharing reaction, resulting in a strong covalent bond between the dye and the compound carried by the modified polypropylene. This so-called nickel chelating system was used to some extent, but its use was eventually discontinued because of poor dye uniformity, cost, and serious pollution problems.

One effective way of coloring polypropylene has been for the producer to incorporate pigments or dyes in the hot melt from which polypropylene fiber or yarn is extruded. This method is known as solution dyeing. The problem with this approach is that the yarn can only be given a single solid color, and solution dyed polypropylene fiber is no easier to dye or print than natural polypropylene.

Thus, while solution dyeing produces polypropylene having a single solid color, until very recently no effective means was available for applying more than one color to polypropylene fiber, such as by space dyeing or printing.

A moderately successful approach to dyeing unmodified polypropylene with more than one color is described in copending U.S. patent application Ser. No. 761,216, filed Sep. 17, 1991 now U.S. Pat. No. 5,358,537. The technique described includes applying a dye solution, or a print paste, containing a disperse dye and a swelling agent or solvent to selected areas of a solution dyed yarn, the dye of the dye solution or print paste being of a color different from that of the solution dyed yarn. The yarn is then subjected to an elevated temperature which causes the applied dye to penetrate and become fixed in the yarn. A problem presented by this method is that the color of the original solution dyed yarn affects the color of the dye subsequently applied to the yarn so that the final color of the yarn, in those areas to which dye was applied, is not true to the color of the applied dye.

It is a general object of the present invention to overcome these and other problems by providing a method of dyeing polypropylene fiber with more than one color, wherein solution dyed fiber can but need not be used, and wherein each color produced in the yarn is true to the color of the dye applied.

It is another object of the present invention to provide such a method employing disperse dyes and the technique of displacement printing or dyeing.

It is a further object of the invention to provide such a method which can be employed with polypropylene unmodified in any way to make it receptive to dyeing.

Additional objects and features of the invention will be apparent from the following description.

As used herein, the term "fiber" is intended to refer to polypropylene in any form in which it is used for textile products such as wearing apparel, upholstery fabrics, and carpeting. Thus, the term is intended to refer to staple fiber, yarn whether in spun or filament form, and fabrics such as those which are knitted, woven, and tufted.

According to the invention, a first dye solution, containing a disperse dye and a dye-promoting agent, is applied to substantially the entire surface of the fiber to cover the fiber with a first color. As used herein, the term "dye solution" is intended to refer to the entire range of dye compositions from completely liquid dye solutions to very viscous print pastes.

While the surface to the polypropylene fiber is still wet with the first dye solution, a second disperse dye solution of a color different from the first color is applied to selected discontinuous areas of the fiber. Because the first dye solution is still wet, the first dye solution is displaced by the second dye solution in those areas where the second dye solution is applied.

The polypropylene fiber is then subjected to an elevated temperature high enough, and for a period of time sufficient to cause the dye to penetrate into, and be fixed in, the fiber. The fiber is then scoured to remove excess dye and chemicals.

When selecting the particular dyes to be used in carrying out the present invention, it must be kept in mind that polypropylene does not contain dye sites or reactive compounds. Hence, disperse dyes have been found to yield optimum performance when used in both the first and second dye solutions applied to the fiber. The size of the dye molecule is significant, and generally dyes which are considered to be of medium or high energy give the best results. In selecting the dyes, the main considerations are those which provide superior light-fastness and a minimum tendency to crock. The following dyes have been found to give good results, but it is understood that other available dyes may give equal or superior results:

C.I. Disperse Yellow 54
Disperse Yellow 2SK (Polychem Ltd.)
Dispersol Yellow B-6G Grains (I.C.I.)
C.I Disperse Orange 25
Disperse Red FT (Polychem Ltd.)

C.I. Disperse Red 60
Disperse Violet 3S (Polychem Ltd.)
C.I. Disperse Blue 56
C.I. Disperse Blue 60
Disperse Blue BA (Polychem Ltd.)

At least the first dye solution applied to the fiber includes a dye-promoting agent. The role of this agent is to increase the dispersing properties of the dyestuff, reduce the surface tension to the polypropylene fiber, and cause the disperse dyes to adhere uniformly to the surface of the fibers. A wide variety of products produce these effects, and hence may be considered dye-promoting agents. In some cases water performs adequately as a dye-promoting agent, and in other cases various chemicals yield the desired results. Since polypropylene is insoluble in almost all chemical agents, it is thought that swelling of the fiber has little to do with the dyeing mechanism of the present invention. The dye-promoting agents which give the best color yields are in general those which are oleophilic in nature and form an oil dispersion with water. These chemicals are compatible with polypropylene, which is a hydrocarbon-based fiber.

The following chemicals have been found to produce high color yields from both the first dye solution applied to the fiber as well as from the overdyed and overprinted solutions subsequently applied to the fiber:

Diethylene Glycol
N-Octyl-2-pyrrolidone
Intracarrier 9P-Biphenyl carrier (highly emulsified)
Octyl Alcohol
Dimethlyl Sulfoxide (at high concentrations)
Thio Diglycol Dye-promoting agents which have not worked as successfully and have produced only fair color yields are the following:

Hostaspur CX-ethoxylated non-ionic wetting agent
N-Cyclohexyl-2 pyrrolidone
Madol 707 - Cationic Softener
Ultrawet 202 - Anionic Wetter
Water
Benzyl Alcohol A typical first dye solution formulation for applying color to the entire surface of the fiber contains at least a disperse dye and a dye-promoting agent. The dye solution may also require a pH adjustment chemical so as to adjust the pH of the dye solution to a value between 1 and 11, and preferably between 2 and 5. Suitable pH adjusting chemicals include formic acid, acetic acid, sulfamic acid, citric acid, phosphoric acid, nitric acid, sulfuric acid, monosodium phosphate, tetrasodium pyrophosphate, trisodium phosphate, ammonium hydroxide, sodium hydroxide, and combinations thereof.

The first dye solution is preferably a liquid so that it can be readily applied to the fiber by dipping the fiber through a trough containing the dye solution, or spraying the dye solution on the fiber, or using a cascading roll technique. However, while the first dye solution is preferably a liquid, it may if desired include a thickener, such as guar gum, so as to increase its viscosity. In fact, while not preferred, the first dye solution could be a print paste. After the first dye solution is applied to the fiber, nipping the fiber through a pressure roll is recommended to ensure uniform dye pick-up.

The second dye solution may be an aqueous solution of a disperse dye, and nothing more. However, preferably the second dye solution is in the form of a print paste, and hence also includes a thickener such as guar gum to increase its viscosity. If necessary, the second dye solution will also include a pH adjusting chemical so as to adjust its pH to a value between 1 and 11, and preferably between 2 and 5. If desired, dye-promoting agents, such as those mentioned above, may be included in the second dye solution. However, use of such chemicals in the second dye solution does not appear to improve the end results sufficiently to merit their additional cost. Furthermore, the second dye solution may include wetting agents, defoamers, softeners, and other dyeing assistants, if desired.

If the second dye solution is in the form of a print paste, it is most convenient to apply it to the fiber using a printing technique, such as roller printing or screen printing. If the second dye solution is in a more liquid form, it may be sprayed or dripped onto the fiber.

The essential point is that the second dye solution be applied to the polypropylene fiber surface while that fiber surface is still wet with the first dye solution which was applied to the entire surface of the fiber. At this time, the first dye solution has not yet dried or penetrated into the fiber, but is merely adhering to the outer surface of the fiber, with the help of the dye-promoting agent. When the thicker print paste is then applied to the fiber, the pressure of the paste causes the first dye solution, which is still unbonded to the fiber, to be displaced from the area to which the print paste is applied. Even if the second dye solution is liquid, no more viscous than the first dye solution, application of the second dye solution, such as by spraying or dripping, causes the first dye solution to be displaced in the areas struck by the second dye solution, the displacement probably being caused by the kinetic energy of the second dye solution striking the fiber surface. Similarly, even where the first dye solution is a print paste, application of the second dye solution in the form of a print paste pushes the first dye solution aside in those areas where the second dye solution is applied.

As pointed out above, it is because the first dye solution is still wet when the second dye solution is applied that the first dye solution is pushed aside or displaced in those areas in which the second dye solution is applied. Because of this displacement mechanism, the color of the second dye solution is unaffected by the color of the first dye solution. This permits the shade of the second dye solution to be lighter than that of the first dye solution, and yet not be affected by the color of the first dye solution. In addition, darker shades can be overdyed or overprinted on light shades without consideration to the particular color of the original lighter shade which has been applied to the fiber.

While thus far, only first and second dye solutions have been mentioned, the second dye solution is representative of one or more additional colors which may be applied to the fiber after the first dye solution has been applied. Thus, the fiber may first have one color applied overall to its surface; and then while that first dye solution is still wet, second, third, and more dye solutions each of a different color may be applied simultaneously, or in series to different areas of the fiber surface.

After the two or more dye solutions have been applied to the polypropylene fiber, the fiber is exposed to a heat treatment to cause the dye to penetrate into, and become fixed in, the fiber. The dye fixation step involves exposing the fiber to dry heat, which may be carried out in an oven. The temperature employed should be at or near the glass transition point of polypropylene, i.e., 280° F., and may even be above the melting point of polypropylene, i.e., 329° F. There is an inverse relationship between the temperature employed and the time during which the fiber is exposed to that temperature. The higher the temperature, the faster the dye fixation, and hence the shorter the exposure time. If the fiber is exposed for too long to a higher temperature, it may harden or melt. Preferably, the dry heat fixation step is carried out at temperature of about 300° F. to 310° F. for a period of one to three minutes, depending upon the air circulation in the drying oven. Dye fixation can also be accomplished at 280° F. for ten minutes or 350° F. for ten seconds. The type of oven available will influence the time and temperature employed for dye fixation in the polypropylene fiber.

Dye fixation can also be carried out using an autoclave. For example, the fiber still wet with the dye solutions may be introduced into an autoclave to accomplish dye fixation. Alternatively, the material may be first dried and then introduced into an autoclave. As another alternative, the dye solutions may first be fixed using dry heat after which the fiber is autoclaved. Autoclaving at a temperature of 275° F. to 285° F., at a pressure of 30 psi. has been found to yield good results. However, autoclaving at almost any temperature will produce some dye fixation.

Different dye fixation methods have been found to vary in effectiveness with respect to color yield and displacement printing in the final dyed fiber. The following table sets forth the order of effectiveness of the dye fixation method on each of these two parameters:

| | DISPLACEMENT PRINTING | COLOR YIELD |
|---|---|---|
| Heat Fix at 310° F.-Autoclave at 275° F. | 1 | 3 |
| Dry at 200° F.-Autoclave at 275° F. | 2 | 4 |
| Heat Fix Only at 310° F. | 3 | 2 |
| Autoclave only at 275° F. | 4 | 5 |
| Heat Fix at 310° F.-Steam at 212° F. | 5 | 1 |
| Steam (wet heat) only at 212° F. | 6 | 6 |

The sample subjected to steam alone showed no displacement printing.

After completion of the dye fixation step, the fiber is scoured to remove excess unfixed dye and residual chemicals. If the fiber is not sufficiently after-scoured, the polypropylene will not pass the required wet and dry crocking tests. The most effective method for after-scouring is to pass the polypropylene material (e.g., yarn, knit tubing, fabric, and carpet) through a series of wash boxes at 160° F. One or more the boxes may contain one of a variety of scouring agents, as desired. The material is then dried at ordinary drying temperatures.

The following examples further illustrate the present invention:

EXAMPLE 1

A knit tubing of 1450/1 denier polypropylene which was solution dyed to a light beige shade was padded through the following first dye solution, and then squeezed through a pressure roll at 60 psi.:

12.0 g/1 Disperse Red FT (dye)
30 g/1 N-octyl 2-pyrrolidone (dye-promoting agent)
1.0% Formic Acid (pH adjuster)
4 g/1 guar gum (thickener)

The entire surface of the tubing was colored solid red and was overprinted, while still wet with the first dye solution, with the following second dye solution in the form of a print paste:

6.0 g/1 Disperse Blue 56 (dye)
8 g/1 guar gum (thickener)
1.0% Formic Acid (pH adjuster)

The knit tubing was placed in a dry heat oven at 310° F. for 7 minutes to fix the dye, after which the tubing was steamed for 8 minutes. The tubing was then washed at 160° F. for 20 seconds, dried at 220 ° F., and deknitted.

The resultant polypropylene yarn was bright red and had intermittent bright blue spots where the blue dye had overprinted and displaced the red dye.

EXAMPLE 2

A sample of 1450/1 denier knit tubing was padded through the following dye paste and nipped at 60 psi.:

5 g/1 C.I. Disperse Blue 56
30 g/1 Diethylene Glycol (dye-promoting agent)
0.5% Formic Acid
4 g/1 guar gum The padded sample carried an overall dull blue color and was overprinted, while still wet, with the following print pastes:

(1) 0 g/1 C.I. Dye (mock dyeing)
8 g/1 guar gum
0.5% Formic Acid
(2) 0.5 g/1 C.I. Disperse Red 60 200%
8 g/1 guar gum
0.5% Formic Acid The overprinted sample was dry heat fixed in an oven at 310° F. for 7 minutes, was after-scoured at 160° F. for 20 seconds, and then was dried at 220° F.

The dried sample showed a clear pad dyed medium bright blue shade. Where the pad dyed shade had been overprinted with print paste (1) (mock dye) the blue dye was displaced and the overprint shade was a very light blue. Where the pad dyed shade had been overprinted with print paste (2), the blue dye was displaced and the overprint was a bluish pink about the same depth as the padded blue shade.

EXAMPLE 3

The steps of Example 2 were repeated, except Intracarrier 9P was substituted for diethelene glycol as the dye-promoting agent. The results were the same as those of Example 2, except that the dyed and overprinted sample exhibited an overall shade with slightly less tinctoral value.

EXAMPLE 4

The steps of Example 2 were repeated, except no chemical dye-promoting agent was used in the pad dye solution (water served as the dye-promoting agent). A clear bright blue shade, overprinted light blue and a bluish pink was obtained with good displacement printing having occurred, except that the overall shade exhibited about 50% less depth than the shade obtained in Example 2.

EXAMPLE 5

A 10 gram sample of 1800/1 denier polypropylene yarn was sprayed with the following dye solution and the nipped at 20 psi pressure:

10 g/1 Disperse Blue 56
25 g/1 N-octyl 2-pyrrolidone
0.3 g/1 Acetic Acid (pH adjuster)

The sprayed yarn carried an overall solid blue shade.

The sample was then overdyed, while still wet, by dropping the following dye solution onto it in a random pattern:

5 g/1 C.I. Disperse Red 60 200%
15 g/1 N-octyl 2-pyrrolidone
1.0% Formic Acid

The sample was heat fixed in an oven for 8 minutes at 280° F., washed at 160° F. for 20 seconds, and then dried at 220° F.

A solid bright blue shade was obtained on the yarn which was intermittently dyed with a bright pink shade.

12.0 g/1 Disperse Blue BA
25 g/1 N-octyl 2-pyrrolidone
1.0% Formic Acid
3 g/1 guar gum The padded sample had an overall medium reddish blue solid shade.

The tubing was then overprinted, while still wet, with the following print pastes:

(1) 6.0 g/1 C.I. Dispersol Yellow B-6G Grains
7 g/1 guar gum
0.5% Formic Acid
(2) 6.0 g/1 Disperse Red FT
7 g/1 guar gum
0.5% Formic Acid The overprinted knit tubing was heat fixed in an oven at 310° F. for 7 minutes, and was then autoclaved for 45 minutes at 275° F. The sample was washed at 160° F. for 20 seconds, after which it was dried at 220° F.

The knit tubing was dyed to a clear bright blue shade with clear bright yellow and bright red shades where the displacement printing had occurred.

EXAMPLE 7

The steps of Example 6 were repeated, except that the sample was dried at 200° F. rather than heat fixed at 310° F. The sample was then autoclaved for 45 minutes at 275° F. The same bright clean print was obtained as in example 6, except that the shades had about 30% less tinctoral value.

EXAMPLE 8

The steps of Example 6 were repeated, except that the sample was steamed for 9 minutes after overprinting. A blue base shade was obtained with well defined overprint colors, except the overprint shades were clearly influenced by the blue base shade.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A method of dyeing pure polypropylene fiber exclusively with disperse dyes to create areas of different color on the fiber, the method comprising the steps of:

applying a first dye solution containing a disperse dye and a dye-promoting agent to substantially the entire surface of the fiber to cover the fiber with a first color, thereafter, and while the fiber surface is still wet with the first dye solution, applying only to selected discontinuous areas of the fiber a second dye solution containing a disperse dye of a second color different from the color of the first color, and thereafter subjecting the fiber to an elevated temperature high enough, and for a period of time sufficient, to fix the dyes in the fiber.

2. A method as defined in claim 1 wherein application of the second dye solution displaces the first dye solution in those areas of the fiber surface to which the second dye is applied.

3. A method as defined in claim 1 wherein the second dye solution is more viscous than the first dye solution.

4. A method as defined in claim 3 wherein the second dye solution includes a thickening agent.

5. A method as defined in claim 4 wherein the thickening agent is guar gum.

6. A method as defined as in claim 1 wherein the first dye solution is applied to the fiber by dipping the fiber through a container of the dye solution, spraying the dye solution, dripping the dye solution on to the fiber, or rolling the dye solution on to the fiber.

7. A method as defined in claim 1 wherein the second dye solution is applied to the fiber by spraying the dye solution, dripping the dye solution, or printing the dye solution on to the fiber.

8. A method as defined in claim 1 including scouring the fiber, after the dye fixation step, to remove excess dye, and then drying the fiber.

9. A method as defined in claim 1 including adjusting the pH of the dye solutions to a value between 1 and 11.

10. A method as defined in claim 1 including adjusting the pH of the dye solutions to a value between 2 and 5.

11. A method as defined in claim 10 wherein the pH is adjusted by adding to the dye solutions a pH adjuster selected from the group consisting of formic acid, acetic acid, sulfamic acid, citric acid, phosphoric acid, nitric acid, sulfuric acid, monosodium phosphate, tetrasodium pyrophosphate, trisodium phosphate, ammonium hydroxide, sodium hydroxide, and combinations thereof.

12. A method as defined in claim 1 wherein the dye-promoting agent is a liquid which increases the dispersing properties of the dye and helps the dye adhere to the surface of the polypropylene fiber.

13. A method as defined in claim 12 wherein the dye-promoting agent is water.

14. A method as defined in claim 12 wherein the dye-promoting agent is oleophilic in nature and forms an oil dispersion with water.

15. A method as defined in claim 14 wherein the dye-promoting agent is selected from the group consisting of diethylene glycol, N-octyl-2-pyrroïidone, biphenyl carriers, octyl alcohol, dimethyl sulfoxide, and thio diglycol.

16. A method as defined in claim 1 wherein the fiber is subjected to a dry heat temperature between 240° F. and 350° F. for a period sufficient to fix the dyes in the fiber.

17. A method as defined in claim 16 wherein the temperature is between 280° F. and 320° F.

18. A method as defined in claim 1 wherein the fiber is subjected to a dry heat temperature between 300° F. and 310° F. for a period of one to three minutes.

19. A method as defined in claim 1 wherein the fiber is autoclaved at elevated pressure and temperature to fix the dyes in the fiber.

20. A method as defined in claim 1 wherein the fiber is in the form of a spun yarn, a filament yarn, a woven or knitted fabric, or a tufted or woven carpet or rug.

21. A method as defined in claim 1 wherein the fiber is polypropylene unmodified in any way to make it receptive to dyeing.

* * * * *